United States Patent [19]

Taylor

[11] Patent Number: 4,646,527

[45] Date of Patent: Mar. 3, 1987

[54] REFRIGERANT RECOVERY AND PURIFICATION SYSTEM

[76] Inventor: Shelton E. Taylor, 4112 Oakellar, Tampa, Fla. 33611

[21] Appl. No.: 790,038

[22] Filed: Oct. 22, 1985

[51] Int. Cl.[4] ..... F25B 47/00

[52] U.S. Cl. ..... 62/85; 62/149; 62/292; 62/475; 62/503

[58] Field of Search ..... 62/85, 149, 292, 475, 62/503

[56] References Cited

U.S. PATENT DOCUMENTS

| | | | |
|---|---|---|---|
| 3,212,284 | 10/1965 | Henderson | 62/149 |
| 3,232,070 | 2/1966 | Sparano | 62/149 |
| 3,302,421 | 2/1967 | Karnes | 62/149 |
| 3,873,289 | 3/1975 | White | 62/292 |
| 4,261,178 | 4/1981 | Cain | 62/149 |
| 4,285,206 | 8/1981 | Koser | 62/292 |
| 4,363,222 | 12/1982 | Cain | 62/149 |
| 4,476,688 | 10/1984 | Goddard | 62/475 |
| 4,539,817 | 9/1985 | Staggs et al. | 62/149 |
| 4,554,792 | 11/1985 | Margulefsky et al. | 62/149 |

*Primary Examiner*—Ronald C. Capossela

*Attorney, Agent, or Firm*—Stein, Reese & Prescott

[57] ABSTRACT

A refrigerant recovery and purification system is disclosed for recovering refrigerant from a heat pump, air conditioner, or other vapor compression refrigerant system into a storage tank while concurrently purifying the recovered refrigerant of impurities and contaminates. The refrigerant recovery and purification system comprises a pair of accumulators connected in line between the compressor and the refrigerant system being evacuated. The output of the compressor is then connected to a heat exchanger positioned within each of the accumulators. The output of the heat exchangers are then connected to a condenser. The accumulators, having the heat exchangers positioned therein, function to distill the refrigerant flowing therethrough to separate the oil, together with the impurities and contaminates normally contained in the refrigerant, thereby purifying the refrigerant being evacuated.

20 Claims, 1 Drawing Figure

REFRIGERANT RECOVERY AND PURIFICATION SYSTEM

BACKGROUND OF THE INVENTION

1. Field of the Invention

This invention relates to vapor cycle air conditioning and heat pump systems. More particularly, this invention relates to systems designed to recover refrigerant within an air conditioning or heat pump system and purify the same for later re-use in the same or other air conditioning or heat pump systems.

2. Description of the Background Art

During the operation of any air conditioning and heat pump system, the refrigerant will become increasingly contaminated by particulate and liquid matter. Eventually, the refrigerant will suffer a degradation of its thermodynamic properties from being contaminated. Hence, refrigerant is typically bled from the system to the atmosphere. After bleeding, the refrigerant system is flushed with an inexpensive gas, such as that sold under the trademark Freon 11, to remove the contaminants and oil which may still exist in the system after bleeding. After bleeding and flushing, the refrigerant system is recharged with new refrigerant. Since the oil in the refrigerant was also bled from the system, the system must also be refilled with a proper amount of oil to be again mixed with the refrigerant for circulation throughout the system.

In addition to general maintenance procedures on refrigerant systems, it is also necessary to bleed the refrigerant to the atmosphere whenever the closed circuit of the refrigerant system is repaired. Indeed, the repair of many components of the refrigerant system (such as the compressor, evaporator, condenser and throttling device) typically require that the entire system be bled of the refrigerant and then, after the repair, recharged.

Obviously, the wasteful bleeding of the refrigerant to the atmosphere is undesirable, both economically and environmentally, inasmuch as some refrigerants (such as Freon) are believed to adversely affect the ozone layer of the earth's atmosphere. Indeed, several refrigerant recovery systems have been developed in various attempts to efficiently recover the refrigerant from the refrigerant system for storage and subsequent recharging of the refrigerant system. The refrigerant recovery systems presently known include those described in U.S. Pat. Nos. 3,232,070, 4,261,178, 4,285,206, 4,363,222 and 4,476,688, the disclosures of which are hereby incorporated by reference herein.

The earliest patent listed above discloses the simplest form of a refrigerant recovery system as including a compressor having its suction inlet connected to the refrigerant system to be evacuated. A condenser is connected to the outlet of the compressor to condense the evacuated refrigerant. The condensed, liquified refrigerant flows through a dryer/strainer into a storage tank. U.S. Pat. No. 4,261,178 and its divisional (4,363,222) discloses a refrigerant recovery system utilizing a positive displacement transfer pump to evacuate the refrigerant from the refrigerant system and flow the evacuated refrigerant through a condenser and then storing the liquid refrigerant in a tank. U.S. Pat. No. 4,285,206 discloses a microprocessor-controlled refrigerant recovery system. Finally, U.S. Pat. No. 4,476,688 discloses a refrigerant recovery system in which refrigerant from the refrigerant system is drawn through an oil trap and acid purification filter/dryer by means of a compressor and then into a condenser. The liquid refrigerant then flows through another acid purification filter/dryer for storage in a receiving tank. A portion of the liquid refrigerant from the receiving tank flows through a return line into a heat exchanger adapted to assist in the condensing of the gaseous refrigerant in the condenser and then recirculate it to the suction side of the compressor.

A major disadvantage to the systems described above is their inability to completely purify the refrigerant during the evacuation and recovery process. Indeed, conventional oil traps and filters only provide a certain degree of purification which, of course, gradually degrades during use until the oil traps and filters are only marginally effective in removing impurities. Consequently, during recharging, the impurities and other contaminants still contained in the refrigerant is undesirably placed back into the refrigerant system even though the refrigerant system may have been properly and effectively flushed of all contaminants.

A still further disadvantage to the systems noted above (based at least in part upon actual use in regard to the unit manufactured and sold by the owner of U.S. Pat. No. 4,476,688) is that the recovery systems do not completely or quickly evacuate the refrigerant from the refrigerant system. Experience has shown that adequate evacuation of the refrigerant can only be attained during operation of the recovery unit over a significantly prolonged period of time. Consequently, the evacuation time required to adequately recover the refrigerant significantly precludes commercial use of the recovery units in applications where speed is important.

Therefore, it is an object of this invention to provide an apparatus and method which overcomes the aforementioned inadequacies of the prior art and provides an improvement which is a significant contribution to the advancement of the refrigerant recovery and purification art.

Another object of this invention is to provide a refrigerant recovery purification system operable to quickly and substantially completely evacuate refrigerant from a refrigerant system for storage in a tank for later re-use.

Another object of this invention is to provide a refrigerant recovery and purification system operable to recover refrigerant from a refrigerant system and purify the same for later storage and re-use.

Another object of this invention is to provide a refrigerant recovery and purification system in which the refrigerant evacuated from the refrigerant system is purified during the recovery process by evaporating the evacuated refrigerant in a tank to distill the evaporated refrigerant from the oil and contaminants thereby purifying the refrigerant to almost its absolute form.

Another object of this invention is to provide a refrigerant recovery and purification system in which the recovered refrigerant is purified by means of an evaporation/distillation process and in which a closed-loop oil separator is fluidly connected to the compressor to circulate oil therethrough, thereby precluding premature burn-out of the compressor which would otherwise occur from compressing refrigerant containing no oil.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a refrigerant recovery and purification system operable to evacuate and recover refrigerant from a refrigerant system, such as a heat pump, air conditioner, refrigerator, freezers and coolers, to a storage tank for later reuse. During the recovery process, the invention further includes means for purifying the evacuated refrigerant to a high degree of purification not attainable through the use of conventional oil traps and filters. The recovery and purification allows the refrigerant system to be economically repaired and maintained without loss of the refrigerant which, in many applications, the value thereof may significantly exceed the cost of a simple repair.

More specifically, the invention comprises a conventional compressor operatively connected to evacuate the refrigerant from the refrigerant system and then condense the evacuated refrigerant by means of conventional condensers for storage in a tank for later reuse. However, the invention also comprises the novel aspect of incorporating one or more accumulators in line between the compressor and the refrigerant system and then operatively connecting the output of the compressor to heat exchangers contained within the accumulators prior to condensing the refrigerant in the condenser. During operation, the compressor evacuates the refrigerant from the refrigerant system into the first accumulator. The refrigerant is evaporated by means of the heat exchanger coil positioned in the accumulator and, then, upon evaporation, flows into the second accumulator. In the second accumulator, the refrigerant is still again evaporated prior to flowing into the suction inlet of the compressor. During the steps of evaporating the refrigerant in each of the accumulators, it is noted that all contaminants are removed from the refrigerant through a distillery process which separates the refrigerant gas from the oil normally contained therein. The separated oil, which contains virtually all of the impurities and contaminants in a refrigerant system, is then drawn out of the accumulators via drains therein. As a result, high grade purified refrigerant flows through the compressor for later condensing and storage in a tank. Indeed, experience has shown that the distilled refrigerant is so free of oil and its impurities and contaminants that the compressor must be supplied with an alternate source of lubrication (oil) or else premature burnout of the compressor will occur. Hence, the invention includes the incorporation of a conventional oil separator to the compressor to assure circulation of oil through the compressor.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a fuller understanding of the nature and objects of the invention, reference should be had to the following detailed description taken in connection with the accompanying drawing in which.

DETAILED DESCRIPTION OF THE PREFERRED EMBODIMENT

Figure 1:
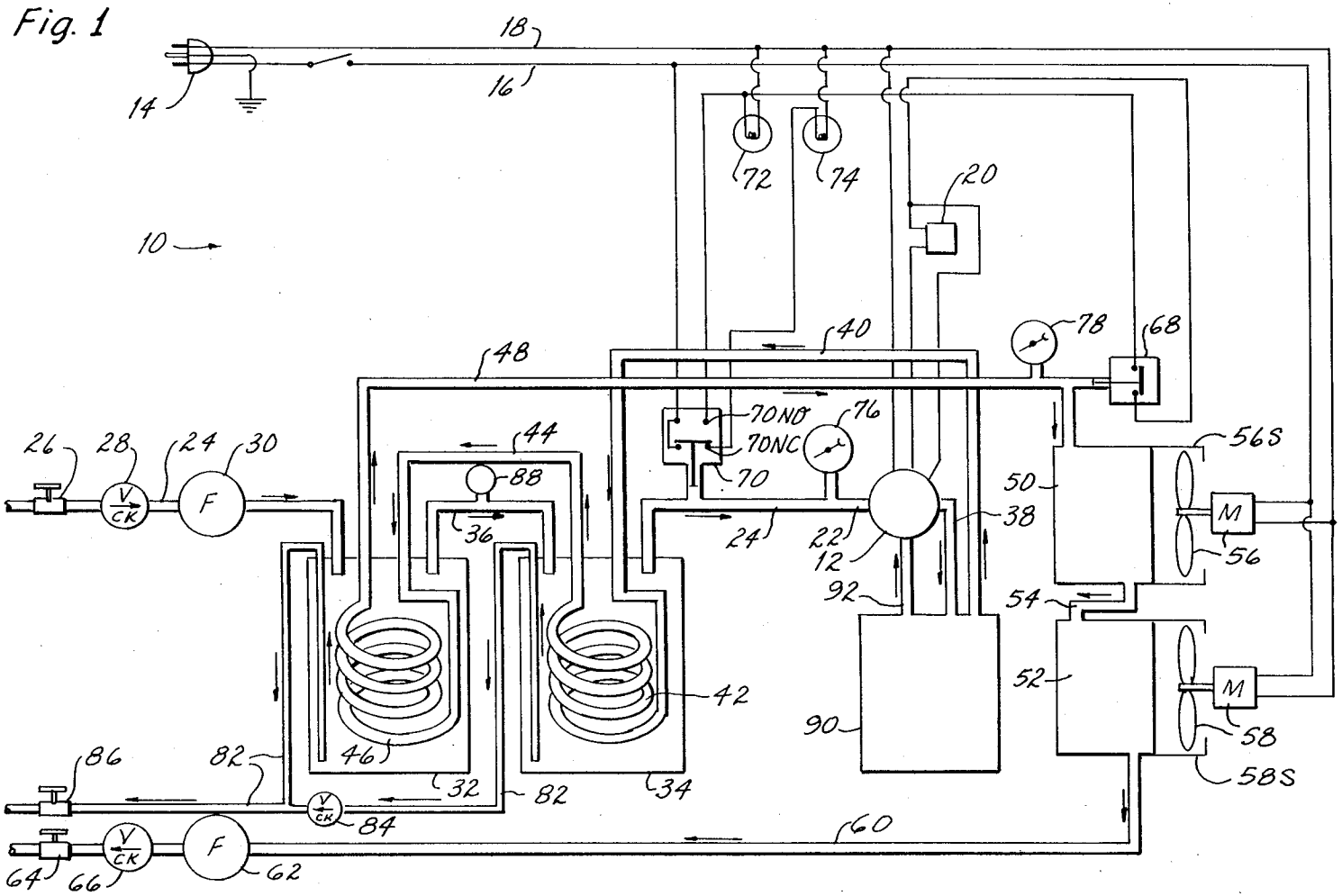
FIG. 1 is schematic flow and electrical diagram of the refrigerant recovery and purification system of the invention.

Referring to FIG. 1 of the drawings, the invention comprises a refrigerant recovery and purification system, generally indicated by the numeral 10, adapted to evacuate and recover the refrigerant contained in a conventional refrigerant system (not shown) such as an air conditioner, heat pump, refrigerator, or cooler. More particularly, the refrigerant recovery and purification system 10 of the invention comprises a compressor 12 electrically connected to an electrical power source represented by plug 14 via power and ground lines 16 and 18, respectively. A startup capacitor 20 is provided for starting of the compressor 12.

The suction input 22 of the compressor 12 is connected via input conduit 24 to the refrigerant system. An input valve 26 and check valve 28 are connected in-line to control the one-way flow of the refrigerant through the input conduit 24. Additionally, a commercial refrigerant filter 30 is connected in-line to filter the largest contaminants and impurities from the refrigerant.

Interposed in the input conduit 24 between the compressor 12 and input valve 26 and check valve 28 is a pair of accumulators 32 and 34. The accumulators 32 and 34 are interconnected by intermediate conduit 36. The input and intermediate conduits 24 and 36 are connected in fluid communication with the upper portions of the accumulators 32 and 34 and do not extend significantly into the bottom portions of the accumulators 32 and 34. The pressurized output 38 of the compressor 12 is serially connected via conduit 40 to a heat exchange coil 42 positioned within the second accumulator 34 and then via intermediate conduit 44 to another heat exchange coil 46 positioned within first accumulator 32. Preferably, both of the heat exchange coils 42 and 46 are adapted so that their input extends from the bottommost portion of the accumulators 32 and 34 and their outputs extend from the upper portions.

The output of the heat exchange coil 46 in the first accumulator 32 is then connected via conduit 48 to a pair of condensers 50 and 52 serially interconnected via intermediate conduit 54. Each condenser 50 and 52 is provided with electrical blower fan 56 and 58, respectively, which are shrouded by shrouds 56S and 58S and electrically connected to power and ground lines 16 and 18.

Output conduit 60 is connected in fluid communication with the output of the second condenser 52 for connection to a separate storage tank (not shown). A commercial refrigerant filter 62 is connected in-line with the output conduit 60 together with cutoff valve 64 and check valve 66 controlling the one-directional flow of the refrigerant through the output conduit 60.

The refrigerant recovery and purification system 10 of the invention further includes a main pressure cut-off switch 68 connected in-line with the compressor 12 to turn off the compressor when the pressure exceeds a pre-set amount. A single-pole, double-throw (SPDT) pressure switch 70 is connected to input conduit 24 between the compressor 12 and the output of the second accumulator 34. The switch's 70 normally open poles 70NO are electrically connected to a white light 72 (and serially with the power lines to the compressor 12) to indicate operation of the compressor 12. Additionally, an amber or red light 74 is connected to the normally closed poles 70NC to indicate turning off the compressor 12. The switch 70 is actuated when the pressure in input conduit 24 reaches a pre-set amount (e.g. 30 lbs.), and is deactuated when the pressure drops to a lower pre-set amount (e.g. 20 lbs.), thereby providing a dwell. This assures that liquid refrigerant in the refrigerant system will freely flow into the first accumulator before operation of the compressor 12. When pressure rises to the pre-set amount switch 70 is actuated, compressor 12 is turned on and operates until the second, lower pre-set pressure is present and switch 70 is deactuated, indicating the evacuation of the refrigeration system. Finally, a low-pressure gauge 76 is connected to the suction input 22 of the compressor 12 and a high-pressure gauge 78 is connected to the input of the first condenser 50 to indicate the low- and high-pressures of the system 10.

During operation, actuation of the main power switch 80 starts compressor 12 running since pressure switch 70 is in its normally closed position as indicated in the drawing. With input conduit 24 connected to the refrigerant system (not shown), the refrigerant contained therein is evacuated therefrom into the first accumulator 32. As the system 10 continues to operate, additional refrigerant is evacuated from the refrigerant system and is drawn into the second accumulator 34 into compressor 12. Still further operation results in the compressor 12 compressing the refrigerant to a vapor or a saturated vapor state whereupon the gaseous refrigerant serially flows through the heat exchange coils 42 and 46 located in the second and first accumulators 34 and 32, respectively. In the heat exchange coils 42 and 46, the gaseous refrigerant is partially condensed due to the heat transfer to the liquid refrigerant contained in the accumulators 32 and 34. Upon exiting the heat exchange coil 46 in the first accumulator 32, the now partially liquified, gaseous refrigerant then flows through the condensers 50 and 52 for complete condensing of the refrigerant. The now completely liquid refrigerant is then stored within a storage tank (not shown) via output 60.

The purification process accomplished by the system 10 of the invention occurs additionally by means of the filter 30 connected to the input conduit 24, which removes the largest impurities and contaminants. However, significantly more purification and decontamination is accomplished within the accumulators 32 and 34 because of the evaporative distilling of the liquid refrigerant as the refrigerant flows from the first accumulator 32 to the second accumulator 34. Indeed, experiments have shown that virtually all of the oil normally contained within the refrigerant is removed during this evaporative distilling process in the accumulators 32 and 34 and, hence, the refrigerant is virtually free of all contaminants and impurities upon exiting the second accumulator 34.

Both of the accumulators 32 and 34 are provided with an oil drain conduit 82 to allow draining of the oil contained within the accumulators 32 and 34. A check valve 84 is provided in the oil drain conduit 82 to prevent backflow of the oil from the first accumulator 32 to the second accumulator 34. Additionally, an output valve 86 is provided for controlling the draining of the oil.

It is noted that the use of two accumulators 32 and 34 becomes necessary only when the first accumulator 32 begins to fill with liquid refrigerant (and oil) to the point of possibly flowing into and slugging the compressor 12 (if the second accumulator 34 was not present.) However, since slugging of the second accumulator 34 is anticipated and actually occurs in practice, a pressure regulator 88 is provided in intermediate conduit 36 to limit the amount of pressure in the second accumulator 34 and, consequently, the level of liquid refrigerant therein. Accordingly, adjustment of pressure regulator 88 has the effect of determining the liquid level in the second accumulator 34.

Finally, due to the removal of virtually all of the oil in the evacuated refrigerant, it has been experimentally shown that the compressor 12 will prematurely fail due to the lack of adequate lubrication. In order to remedy this problem, a separate oil separator 90 filled with an appropriate level of clean oil is connected in fluid communication with the oil recirculation line 92 of the compressor 12 to supply oil to the compressor 12 thereby precluding the premature failure thereof.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described, what is claimed is:

1. A refrigerant recovery and purification system for recovering and purifying refrigerant from a vapor compression refrigerant system, comprising in combination:

input conduit;

means for connecting said input conduit to the vapor compression refrigerant system;

compressor means having an input and an output;

first accumulator means fluidly connected between said input conduit and said input of said compressor means;

first heat exchange coil means having an input connected in fluid communication with said output of said compressor means and an output, said heat exchange coil means being positioned in heat exchanging relationship with said first accumulator means;

condenser means having an input connected in fluid communication with said output of said first heat exchange coil means and an output;

output conduit connected in fluid communication with said output of said condenser means; and means for connecting said output conduit to a storage tank for storage of purified and recovered refrigerant, whereby, upon operation of said compressor means, the refrigerant in the vapor compression refrigerant system is evacuated from said vapor compression refrigerant system and accumulated in said accumulator means, a portion of which is vaporized by means of heat applied by said first heat exchange coil means to flow into said compressor means, through said first heat exchange coil means and then completely condensed to a liquid state by said condenser means for storage in the storage tank.

2. The refrigerant recovery and purification system as set forth in claim 1, further including a second accumulator means connected in fluid communication between said first accumulator means and said input of said compressor means and further including a second heat exchange coil means connected in fluid communication between said output of said compressor means and said input of said first heat exchange coil means and positioned in heat exchanging relationship with said second accumulator means, whereby any liquid refrigerant flowing from the vapor compression refrigerant system into said second accumulator means is further vaporized by heat provided by said second heat exchange coil means prior to flowing into said input of said compressor means.

3. The refrigerant recovery and purification system as set forth in claim 2, further including an auxiliary oil separator means containing oil and connected in fluid communication with said compressor means to circulate the oil through said compressor means to lubricate the same.

4. The refrigerant recovery and purification system as set forth in claim 3, further including pressure switch means connected to sense pressure at said input of said compressor means to actuate said compressor means when such pressure is above a pre-set amount and to terminate operation of said compressor means when such pressure is below another pre-set amount.

5. The refrigerant recovery and purification system as set forth in claim 4, further including oil return means in each said accumulator means for draining accumulated oil from said accumulator means.

6. The refrigerant recovery and purification system as set forth in claim 5, further including an input filter means connected in fluid communication with said input conduit to filter the refrigerant prior to flowing into said first accumulator means.

7. The refrigerant recovery and purification system as set forth in claim 6, further including output filter mean connected in fluid communication with said output conduit to filter the liquid refrigerant prior to flowing into the storage tank.

8. The refrigerant recovery and purification system as set forth in claim 7, further including check valve means connected in fluid communication with said input conduit to regulate the one-directional flow of the refrigerant therethrough.

9. The refrigerant recovery and purification system as set forth in claim 8, further including check valve means connected in fluid communication with said output conduit to regulate the one-directional flow of the refrigerant therethrough.

10. The refrigerant recovery and purification system as set forth in claim 2, further including pressure regulator means connected in fluid communication between the output of said first accumulator means and said second accumulator means to regulate the pressure in said second accumulator means and therefore the liquid level therein.

11. A method for recovering and purifying refrigerant from a vapor compression refrigerant system, comprising the steps of:

providing an input conduit;

connecting said input conduit to the vapor compression refrigerant system;

providing compressor means having an input and an output;

providing first accumulator means fluidly connected between said input conduit and said input of said compressor means;

providing first heat exchange coil means having an input connected in fluid communication with said output of said compressor means and an output, said heat exchange coil means being positioned in heat exchanging relationship with said first accumulator means;

providing condenser means having an input connected in fluid communication with said output of said first heat exchange coil means and an output:

providing output conduit connected in fluid communication with said output of said condenser means; and connecting said output conduit to a storage tank for storage of purified and recovered refrigerant, whereby, upon operation of said compressor means, the refrigerant in the vapor compression refrigerant system is evacuated from said vapor compression refrigerant system and accumulated in said accumulator means, a portion of which is vaporized by means of heat applied by said first heat exchange coil means to flow into said compressor means, through said first heat exchange coil means and then completely condensed to a liquid state by said condenser means for storage in the storage tank.

12. The refrigerant recovery and purification method as set forth in claim 11, further including the step of providing second accumulator means connected in fluid communication between said first accumulator means and said input of said compressor means and further including the step of providing a second heat exchange coil means connected in fluid communication between said output of said compressor means and said input of said first heat exchange coil means and positioned in heat exchanging relationship with said second accumulator means, whereby any liquid refrigerant flowing from the vapor compression refrigerant system into said second accumulator means is further vaporized by heat provided by said second heat exchange coil means prior to flowing into said input of said compressor means.

13. The refrigerant recovery and purification method as set forth in claim 12, further including the step of providing an auxiliary oil separator means containing oil and connected in fluid communication with said compressor means to circulate the oil through said compressor means to lubricate the same.

14. The refrigerant recovery and purification method as set forth in claim 13, further including the step of providing pressure switch means connected to sense pressure at said input of said compressor means to actuate said compressor means when such pressure is above a pre-set amount and to terminate operation of said compressor means when such pressure is below another pre-set amount.

15. The refrigerant recovery and purification method as set forth in claim 14, further including the step of providing oil return means in each said accumulator means for draining accumulated oil from said accumulator means.

16. The refrigerant recovery and purification method as set forth in claim 15, further including the step of providing an input filter means connected in fluid communication with said input conduit to filter the refrigerant prior to flowing into said first accumulator means.

17. The refrigerant recovery and purification method as set forth in claim 16, further including the step of providing output filter means connected in fluid communication with said output conduit to filter the liquid refrigerant prior to flowing into the storage tank.

18. The refrigerant recovery and purification method as set forth in claim 17, further including the step of providing check valve means connected in fluid communication with said input conduit to regulate the one-directional flow of the refrigerant therethrough.

19. The refrigerant recovery and purification system as set forth in claim 18, further including the step of providing check valve means connected in fluid communication with said output conduit to regulate the one-directional flow of the refrigerant therethrough.

20. The refrigerant recovery and purification method as set forth in claim 12, further including the step of providing pressure regulator means connected in fluid communication between the output of said first accumulator means and said second accumulator means to regulate the pressure in said second accumulator means and therefore the liquid level therein.

* * * * *